US006648449B2

(12) United States Patent
Gonzalez

(10) Patent No.: US 6,648,449 B2
(45) Date of Patent: Nov. 18, 2003

(54) PRINTHEAD CLEANER CASSETTE WITH SWITCHABLE WIPERS

(75) Inventor: Charlene Gonzalez, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 6 days.

(21) Appl. No.: 09/920,019

(22) Filed: Aug. 1, 2001

(65) Prior Publication Data

US 2003/0025756 A1 Feb. 6, 2003

(51) Int. Cl.[7] ..... B41J 2/165
(52) U.S. Cl. ..... 347/33
(58) Field of Search ..... 347/33, 22, 23; 15/250.361, 256.5, 256.51, 256.52

(56) References Cited

U.S. PATENT DOCUMENTS 5,103,244 A 4/1992 Gast et al. ..... 347/32
5,896,145 A * 4/1999 Osborne et al. ..... 347/33
6,174,041 B1 1/2001 Urrutia et al. ..... 347/22

FOREIGN PATENT DOCUMENTS

JP 362111751 A * 5/1987 ..... 347/33

* cited by examiner

*Primary Examiner*—Shih-wen Hsieh

(57) ABSTRACT

A servicing cassette for an inkjet printhead includes wiper blades which may be manually or automatically switched when worn or having reached the end of their intended service life without the necessity of replacing the entire servicing cassette. The wiper blades are mounted on a rotary support in the cassette which is held by a latch to confine rotation of the support and wiper blades to a single direction and which holds the wiper blades in stationary position relative to the cassette when servicing an associated inkjet printhead. A wiper switching actuator is affixed to printer structure and engages a wiper switching arm on the rotary blade support to rotate the support and move a second wiper or wiper pair into servicing position by relatively moving the servicing cassette and the actuator when the intended service life of the first wiper or wiper pair has been reached.

13 Claims, 3 Drawing Sheets

PRINTHEAD CLEANER CASSETTE WITH SWITCHABLE WIPERS

CROSS REFERENCE TO RELATED APPLICATIONS

None.

BACKGROUND OF THE INVENTION

The present invention relates generally to the art of inkjet printing and, more particularly, to a printhead service cassette which may contain cleaning fluid or other type of servicing fluid and printhead wipers and other elements for contacting and thereby servicing the orifices of an inkjet printhead. Inkjet printers may utilize a scanning carriage on which one or a plurality of inkjet printheads, usually containing different colors of ink, are mounted to scan back and forth across media on which printing is to take place. Other inkjet printers, with which the present invention is equally applicable, do not use a scanning printhead carriage but instead mount a plurality of inkjet printheads in stationary position relative to the moving media on which printing is to take place.

In inkjet printers which use scanning printhead carriages, a printhead service station containing a plurality of printhead servicing cassettes, usually equal in number to the number of inkjet printheads mounted on the carriage, may be provided, usually at one end of the path of travel of the scanning printhead carriage. Those skilled in the art will appreciate that multiple service stations can also be employed such as one at each end of the path of travel of a scanning printhead carriage or the service station may be located somewhere between the ends of the path of travel of the printhead carriage if desired. Inkjet printers with which the present invention may be used may be relatively small format such as desktop size or large format printers capable of printing on media of as much as 60" in width or even wider. The media on which printing is to take place may be paper, vellum, textile or any other suitable media supplied in either roll form or individual sheet form.

Particularly in large format printers used for printing on textiles, the inkjet printheads must be frequently wiped and otherwise serviced. This is due, in part, to the fact that airborne textile fibers contaminate the working environment requiring more frequent wiping of the printheads and because inks for printing on textiles are more aggressive than traditional inkjet acid-based inks. Also, due to absorptivity of textile fabric, ink may have to be repeatedly applied to individual locations on the media by the same or different inkjet printheads in order to obtain the necessary final desired color and color density and contrast. Accordingly, inkjet printheads containing a relatively large capacity of ink (about 1500 cc for example, versus 750 cc for a conventional inkjet printhead) have been developed. The use of large capacity inkjet printheads and the frequent printhead wiping to remove airborne textile fibers requires more frequent changing of printhead cleaner cassettes which, in turn, is very inconvenient for the user since, particularly in industrial/commercial printing applications such as textile printing, downtime of the printer during changing of the printhead cleaner cassettes is critical and user interventions should be minimized.

It is accordingly the primary objective of the present invention to provide a printhead servicing cassette in which the printhead orifice wiper may easily be replaced when worn or at the end of its intended service life without requiring the user to replace the entire printhead servicing cassette.

SUMMARY OF THE INVENTION

The present invention therefore provides an inkjet printhead servicing cassette comprising a housing and at least one printhead wiper blade extending in operative position from said housing, a rotary blade support mounted in said housing, said support having plural ones of said wiper blades mounted thereon at angularly spaced positions and mechanism for rotating said blade support to move a wiper blade from operative position to inoperative position as another wiper blade is moved from inoperative position to operative position.

The present invention further provides an inkjet printer having at least one inkjet printhead, at least one printhead servicing cassette for engagement with said printhead, said servicing cassette comprising a housing and at least one printhead wiper blade extending in operative position outside of said housing for contacting said printhead, a rotary blade support mounted in said housing, said support having plural ones of said blades mounted thereon at angularly spaced positions and mechanism for rotating said blade support to move one blade from operative position to inoperative position as another blade is moved from inoperative position to operative position.

DETAILED DESCRIPTION OF THE PREFERRED EMBODIMENT

Figure 1:
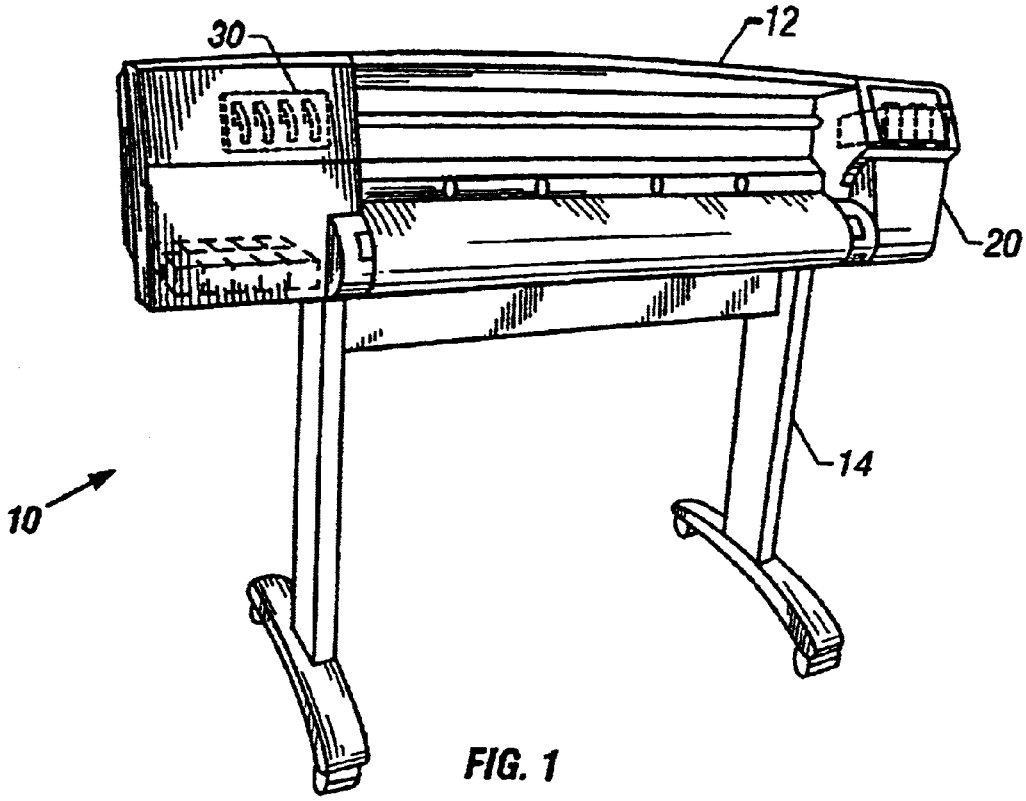
FIG. 1 is a perspective view of a typical printer in which the present invention may be used.
Figure 2:
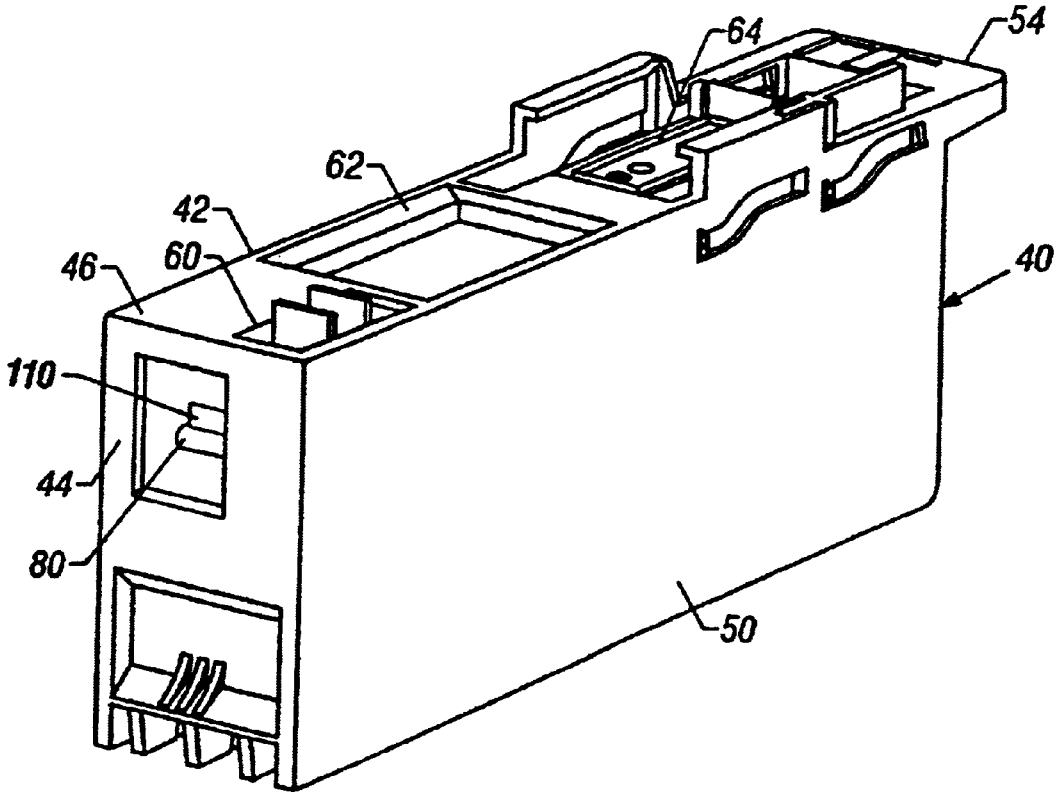
FIG. 2 is a perspective view of the printhead cleaner cassette of the present invention.

In the following description and drawings of the preferred embodiment of the invention, like elements are identified with like reference numerals.

In FIG. 1 a large format printer, is shown of the type having a scanning printhead carriage enclosed by a housing 12. A printhead service station 20 is located in the housing at the right end of the path of travel of the printhead carriage and offboard ink supplies 30 may be provided (as shown at the left end of the path of travel of the printhead carriage in FIG. 1) connected by tubing (not shown) to replenish ink to carriage borne printheads. In printers of the type not having a scanning printhead carriage, the printheads are stationary and will contain a relatively large supply of ink as compared with carriage borne printheads. In the embodiment shown, the printer is mounted on a stand 14 but, as indicated above, the invention is equally applicable to smaller printers such as those of desktop size and printers which do not necessarily have a scanning printhead carriage.

Individual printhead servicing cassettes 40 which may be of the type shown, for example, in U.S. Pat. No. 6,174,041 issued Jan. 16, 2001, to Martin Urrutia, et al., and assigned to the assignee of the present invention, the disclosure of which is incorporated herein by reference, are individually mounted in the service station 20 in position for servicing the various printheads.

Each servicing cassette 40 pursuant to the present invention is comprised of a plastic housing 42 having a rear wall 44, a front wall (not shown), a top wall 46, spaced generally parallel side walls 48, 50 and a bottom wall 52. A gripping handle 54 extends forwardly (toward the user when facing the printer) as is conventional. The top wall 46 of the housing is provided with apertures 60 for a printhead wiper or plural wipers, 62 for a printhead spittoon and 64 for a printhead capping and servicing mechanism. The rear wall 44 has an aperture 66 therein for a purpose to be described.

Figure 3:
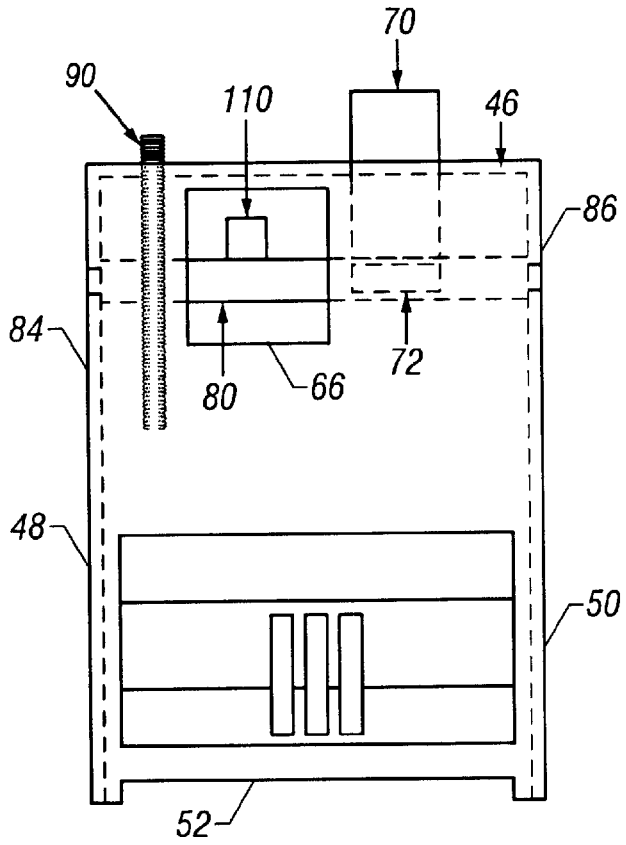
FIG. 3 is a rear side elevation view of the cleaner cassette of FIG. 2.
Figure 4:
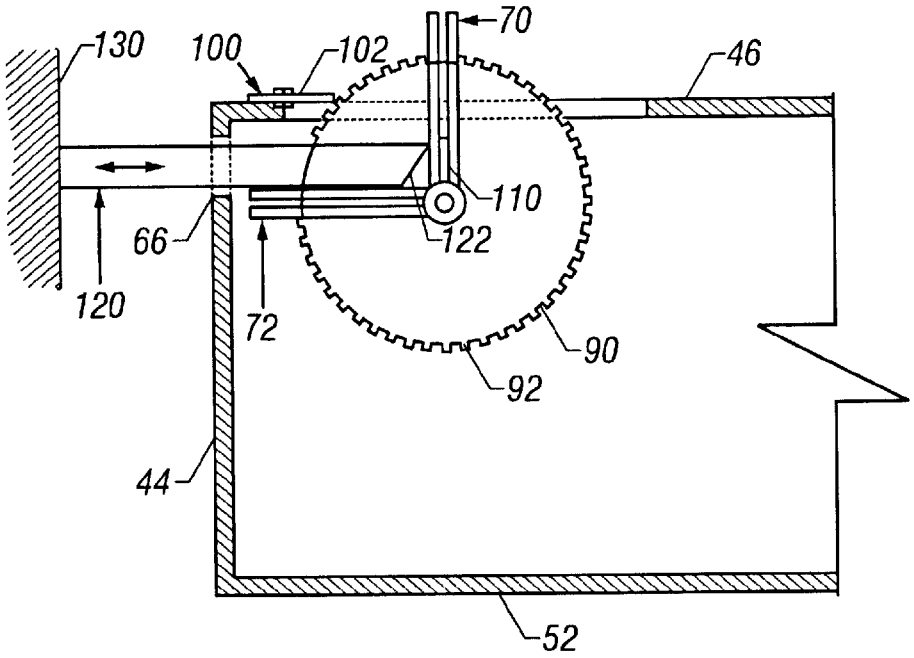
FIG. 4 is a right side cross-sectional elevation view of the cleaner cassette.
Figure 5:
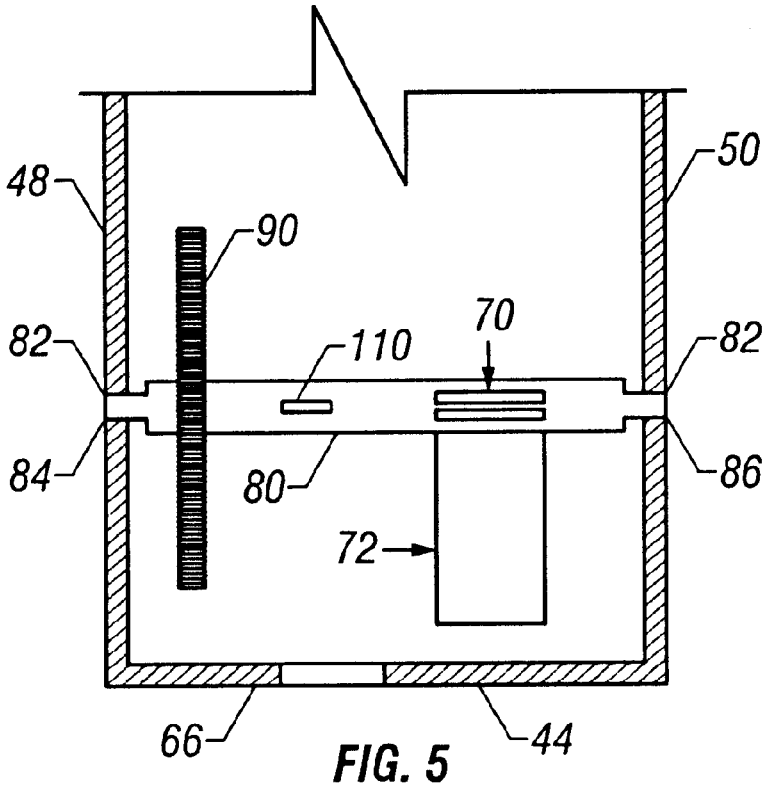
FIG. 5 is a top plan view of the cleaner cassette.
Figure 6:
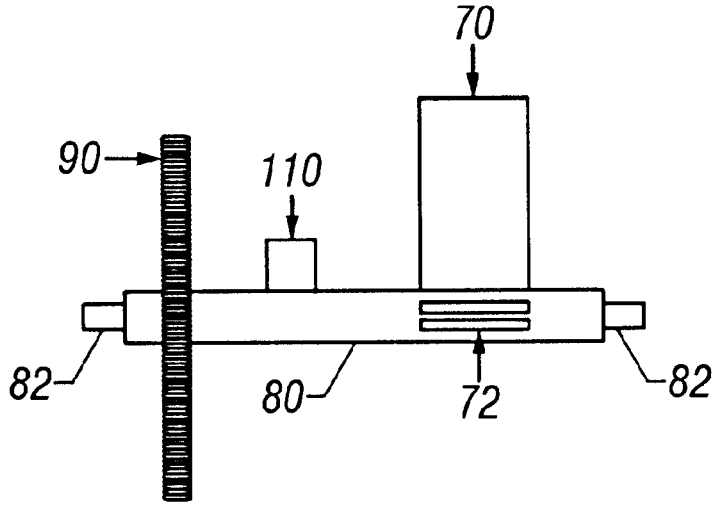
FIG. 6 is a rear elevation view of a rotary wiper blade support.

In accordance with the present invention, resilient printhead wiper blades 70, 72 are affixed to a rotary blade support 80 at angularly spaced positions, preferably 90° as seen in FIG. 4, so that the wiper blades, which may comprise single blades at the angularly spaced locations or dual spaced wiper blades at each of the angularly spaced positions can be moved into operative position for wiping the orifices of an inkjet printhead when the wiper blades 70, 72 extend outwardly of the housing 42 through the wiper aperture 60. The rotary wiper support 80 may be comprised of a shaft or axle having reduced diameter ends 82 rotatably mounted in bearings 84, 86 provided in the spaced side walls 48, 50 of cassette housing 42. A wiper latch gear 90 having teeth 92 thereon is also affixed to the rotary wiper blade support 80 near the left end of the support 80 as seen in FIG. 3. A latch 100, preferably, a resilient leaf spring, is affixed in any suitable fashion to the housing 42 and projects in a direction such that a cantilevered end 102 of the latch engages the teeth 92 on the latch gear 90 to limit rotation of the rotary blade support 80 to a single direction.

A wiper switching arm 110 is also affixed to the rotary wiper blade support 80 and projects radially a distance so that it can be engaged by a wiper switching actuator 120 when the initially used wiper blade or blade pair 70 is to be rotated from its operative position in which it extends outwardly of the housing 42 through the wiper aperture 60 outside of the housing 42 to an inoperative position as the second blade pair 72 is rotated into operative position to extend through the aperture 60. The wiper switching actuator 120 is affixed to printer chassis structure 130 and has a beveled or otherwise angled end 122 which is slideably engageable with the wiper switching arm 110 for rotating the rotary blade support 80 to switch the wipers 70, 72 when worn or at the end of their service life.

Various alternative ways of moving the second wiper or dual wiper 72 into operative position as the first wiper 70 is moved from operative position to inoperative position are contemplated. If the printhead servicing cassettes are mounted on a movable carriage as shown, for example, in the aforementioned U.S. Pat. No. 6,174,041, provision can be made for automatically moving the entire service station carriage and servicing cassettes thereon rearwardly with respect to the printer (away from an operator facing the printer) when the service life of the first wiper blade 70 has been reached, as determined, for example by inkjet drop counting, so that the servicing cassettes will all move toward an equal number of wiper switching actuators 120 mounted on the printer chassis so as to cause the angled ends 122 to enter the respective apertures 66 in the rear walls 44 of the cassettes so that they can engage the wiper switching arms 110 and thus rotate the wiper blade supports 80 to move the second wipers or wiper pairs 72 into operative position as the first wipers or pairs 70 are rotated to inoperative position. Reverse rotation of the rotary blade support 80 is prevented by the leaf spring latch engagement with the teeth 92 of the latch gear 90. Alternatively, provision can be made for manually moving the printhead cleaner cassettes 40 individually or simultaneously in a direction to engage the angled ends of the wiper switching actuators 120 when wiper switching is required.

Since different printhead cassettes contain different inks which are exhausted at different rates and times, individually movable wiper switching actuators 120 which are activated depending on the drop counts of ink fired by the various printheads can be used to automatically switch the wiper blades 70, 72 in the printhead cleaner cassettes 40 when the ink supplies in the associated printheads have been depleted to the amount at which switching is desired.

Mounting of more than two wiper blades or blade pairs 70, 72 on each rotary wiper blade support 80 is also contemplated although the design of an apparatus which employs more than two wipers or wiper pairs becomes necessarily more complex.

As is conventional, the wiper blades may be made of flexible elastomer or plastic, nitrile rubber or other rubber-like material, preferably of an ethylene polypropylene diene monomer (EPDM).

Persons skilled in the art will also appreciate that various additional modifications can be made in the preferred embodiment shown and described above and that the scope of protection is limited only by the wording of the claims which follow.

What is claimed is:

1. An inkjet printhead servicing cassette comprising a housing and at least one printhead wirier blade extending in operative position from said housing, a rotary blade support mounted in said housing, said support having plural ones of said wiperblades mounted thereon at angularly spaced positions, a latch for limiting rotation of said support to a single direction and mechanism for rotating said blade support to move a wiper blade from operative position to inoperative position as another wiper blade is moved from inoperative position to operative position, wherein said mechanism for rotating includes a wiper switching arm affixed to said support and further comprising an aperture in said housing for reception of a wiper switching actuator engageable with said wiper switching arm.

2. The cleaner cassette of claim 1, wherein said support is supported between spaced walls of said housing and said aperture is in another wall of said housing.

3. The cleaner cassette of claim 1, wherein said blades are mounted on said support at angular spacing of about 90 degrees.

4. The cleaner cassette of claim 3, wherein each of said blades is flexible.

5. The cleaner cassette of claim 4, wherein each of said blades is a single blade.

6. The cleaner cassette of claim 4, wherein each of said blades includes a pair of substantially parallel blade portions.

7. An inkjet printhead servicing cassette comprising a housing and at least one printhead wiper blade extending in operative position from said housing, a rotary blade support mounted in said housing, said support having plural ones of said wiper blades mounted thereon at angularly spaced positions and mechanism for rotating said blade support to move a wiper blade from operative position to inoperative position as another wiper blade is moved from inoperative position to operative position, said mechanism for rotating including a wiper switching arm affixed to said support, said housing including an aperture for reception of a wiper switching actuator engageable with said wiper switching arm.

8. An inkjet printer having at least one inkjet printhead, at least one printhead servicing cassette for engagement with said printhead, said servicing cassette comprising a housing and at least one printhead wiper blade extending in operative position outside of said housing for contacting said printhead, a rotary blade support mounted in said housing, said support having plural ones of said blades mounted thereon at angularly spaced positions and mechanism for rotating said blade support to move one blade from operative position to inoperative position as another blade is moved from inoperative position to operative position, wherein said mechanism for rotating said blade support comprises a wiper switching actuator affixed to printer chassis and a wiper switching arm affixed to said blade support, said cassette being moveable with respect to said printer to engage said actuator with said wiper switching arm to rotate said blade support.

9. The printer of claim 8, wherein said support is rotatably supported between spaced walls of said housing and further comprising an aperture in another wall of said housing for reception of said actuator.

10. The printer of claim 9, further comprising a latch gear affixed to said support and a latch affixed to said housing, said latch being engaged with said gear for limiting rotation of said support to a single direction.

11. The printer of claim 10, wherein said latch comprises a leaf spring.

12. The printer of claim 10, wherein said blades are mounted on said support at angular spacing of about 90 degrees.

13. An inkjet printer having at least one inkjet printhead, at least one printhead servicing cassette for engagement with said printhead, said servicing cassette comprising a housing and at least one printhead wiper blade extending in operative position outside of said housing for contacting said printhead, a rotary blade support mounted in said housing, said support having plural ones of said blades mounted thereon at angularly spaced positions and mechanism for rotating said blade support to move one blade from operative position to inoperative position as another blade is moved from inoperative position to operative position, said mechanism for rotating comprising a wiper switching actuator affixed to printer chassis and a wiper switching arm affixed to said blade support, said wiper switching actuator being moveable with respect to printer chassis structure to engage said wiper switching arm to rotate said blade support.

* * * * *